United States Patent [19]

Miller et al.

[11] 3,976,888

[45] Aug. 24, 1976

[54] FISSION FRAGMENT DRIVEN NEUTRON SOURCE

[75] Inventors: Lowell G. Miller; Robert C. Young, both of Idaho Falls, Idaho; Robert M. Brugger, Columbia, Mo.

[73] Assignee: The United States of America as represented by the United States Energy Research and Development Administration, Washington, D.C.

[22] Filed: Jan. 23, 1975

[21] Appl. No.: 543,610

[52] U.S. Cl. ..... 250/500; 250/390; 176/17

[51] Int. Cl.[2] ..... G21G 4/02

[58] Field of Search ..... 250/499, 500, 501, 502, 250/390, 391, 392; 176/17

[56] References Cited

UNITED STATES PATENTS

| | | | |
|---|---|---|---|
| 3,113,082 | 12/1963 | Imhoff et al. | 250/500 X |
| 3,290,500 | 12/1966 | Bokhari et al. | 250/391 |
| 3,453,175 | 7/1969 | Hodge | 250/499 X |
| 3,748,475 | 7/1973 | Shatas et al. | 250/502 |

*Primary Examiner*—Archie R. Borchelt
*Attorney, Agent, or Firm*—Dean E. Carlson; Arthur A. Churm; Hugh W. Glen

[57] ABSTRACT

Fissionable uranium formed into a foil is bombarded with thermal neutrons in the presence of deuterium-tritium gas. The resulting fission fragments impart energy to accelerate deuterium and tritium particles which in turn provide approximately 14 MeV neutrons by the reactions $t(d,n)^4$ He and $d(t,n)^4$He.

10 Claims, 2 Drawing Figures

39
He
$D_2T_2$
40
He SEPARATION
35
37
V
V
33
16
11
15
32
19
31
23
21
25
20
13
17

FISSION FRAGMENT DRIVEN NEUTRON SOURCE

CONTRACTUAL ORIGIN OF THE INVENTION

The invention described herein was made in the course of, or under, a contract with the UNITED STATES ATOMIC ENERGY COMMISSION.

BACKGROUND OF THE INVENTION

The present invention relates to high energy neutron sources, particularly sources of about 14 MeV neutrons for simulating radiation exposures that may be encountered within controlled thermonuclear reactor (CTR) devices.

Several areas of research have been identified as requiring neutron sources capable of providing large fluxes and fluences of 14 MeV neutrons. Applicants' recent report, "Fission Fragment Driven ($d + t$) Neutron Irradiation Source for CTR Materials Damage Irradiations", Aerojet Nuclear Co., ANCR–1134 (1974) lists a number of these applications respecting the testing of materials. This report is hereby expressly incorporated by reference. Those applications to which the present invention are thought to be particularly applicable include:

Cross Sections and Related Nuclear Data

The measurement of reaction cross sections, particularly for activation cross sections of reactions for which the target is scarce and/or the product has a long half life, and for the ($n$, $^4$He), ($nn'$, $^4$He) etc. reactions by which helium is produced.

Source Description
Energy Range: 2–14 MeV
Intensity: $10^5$–$10^8$ $n$/sec
Geometry: point source, beam flux

Radiolysis in Materials

Measurement Description
- Radiation effect on hydrogen, deuterium and tritium permeabilities in vacuum wall and structural materials.
- Radiolysis of molten salt coolants and/or breeding blanket.
- Radiation decomposition of LiD, LiT, shielding and structural materials (e.g. borated water, organic materials for seals, etc.).
- Radiation effect in trapping efficiencies in diverter materials.

Source Description
Energy Range: keV — 14 MeV
Intensity: $10^9$–$10^{10}$ $n$/cm$^2$-sec
Fluence: $10^{18}$ $n$/cm$^2$
Geometry: beam flux, in-core irradiation

Surface Physics

Measurement Description
- Vacuum wall erosion
  - Sputtering
  - Radiation blistering by reaction products: ($n$,He), ($n$,$p$), etc.
  - Particle desorption by direct neutron and reaction product interactions.
  - Photo-decomposition of surface compounds by neutron-induced energetic photons and reaction products.
  - Radiation damage in surface layers.
- Plasma contamination

- Multiple backscattering
  - Secondary particle emission
  - Secondary electron emission (electron sheath formation).

Source Description
Energy Range: keV – 14 MeV
Intensity (at sample surface): $>10^{12}$ $n$/cm$^2$-sec
Fluence (yield 0.1 monolayer): $3 \times 10^{17}$ $n$/cm$^2$
High Fluence Effects: $10^{20}$–$10^{21}$ $n$/cm$^2$
Geometry: point source, beam flux

Material Radiation Damage

Measurement Description
- Neutron fluence effects on physical and mechanical properties: creep strength, and loss of ductility in vacuum wall and structural material at temperatures in range of 500°–1000°C.
- Synergistic effect of high gas generation and point defect production rates in a high flux of high energy neutrons on void formation at temperatures in the range of 500°–1000°C.
- Establish correlation between heavy-ion bombardment effects and neutron radiation effects at several energies (discrete or integral) in the range of 2–14 MeV.
- Transmutation effects on physical and mechanical properties of structural materials.

| Source Description | |
|---|---|
| Energy Range: | keV – 14 MeV |
| Intensity (long term): | $>10^{15}$ n/cm$^2$-sec |
| High Fluence: | $10^{23}$–$10^{24}$ n/cm$^2$ |
| Intensity (correlation experiments): | $10^{13}$–$10^{14}$ n/cm$^2$-sec |
| Minimum Fluence: | $10^{20}$ n/cm$^2$ |
| Geometry: | point source, beam flux in-core irradiation |

From such studies predictions as to material swelling, transmutation of elements, void formation, changes in superconducting properties and various other materials' characteristics are to be obtained.

For the studies relating to materials radiation damage extremely high neutron fluxes (up to $3 \times 10^{12}$, 14 MeV n/cm$^2$-sec) and fluences ($10^{20}$, 14 MeV n/cm$^2$) may be required. Many facilities existing at present or presently proposed have various limitations either to these flux levels, to the required neutron energy or in that they are not conveniently available for materials testing. Table I below includes a partial list of existing neutron source facilities. A more comprehensive list is included within applicants' recent report ANCR–1134, (1974), cited above.

TABLE I

NEUTRON SOURCE FACILITIES
A. Nuclear Reactors

Experimental Breeder Reactor EBR-II (ANL)

Fast neutron flux facility; in-core irradiaton capability.
Neutron Flux Data:

| Energy Range | Radial Position (n/cm$^2$-sec) Core Center | Edge of Core |
|---|---|---|
| >3.7 MeV | $0.08 \times 10^{15}$ | $0.04 \times 10^{15}$ |
| 1.35 MeV–3.7 MeV | $0.45 \times 10^{15}$ | $0.20 \times 10^{15}$ |
| 100 keV–1.35 MeV | $1.70 \times 10^{15}$ | $1.18 \times 10^{15}$ |
| 1–100 keV | $0.45 \times 10^{15}$ | $0.33 \times 10^{15}$ |
| <1 keV | | |
| Total | $2.68 \times 10^{15}$ | $1.75 \times 10^{15}$ |

TABLE I-continued

| NEUTRON SOURCE FACILITIES A. Nuclear Reactors | | |
|---|---|---|
| High Flux Isotope Reactor HFIR (ORNL) | | |
| Thermal neutron flux facility; in-core irradiation capability. Neutron Flux data: | | |
| | Radial Position (n/cm²-sec) | |
| Energy Range | Central Region | Fuel Region |
| >1.35 MeV | $5.21 \times 10^{14}$ | |
| 111 keV–1.35 MeV | $6.80 \times 10^{14}$ | |
| 9 keV–111 keV | $3.18 \times 10^{14}$ | |
| 0.4 eV–9 keV | $1.06 \times 10^{15}$ | |
| Nonthermal (max) | | $4.0 \times 10^{15}$ |
| Thermal | $2.8 \times 1^{15}$ | |

TABLE I

| NEUTRON SOURCE FACILITIES B. Accelerator and Target Systems | | |
|---|---|---|
| Los Alamos Meson Physics Facility LAMPF (LASL) | | |
| High-current proton accelerator. | | |
| Beam Energy, MeV | 800 | |
| Ion Current (average), mA | 1 | |
| Cycle Time, pps | 120 | |
| Pulse Width ($\Theta_p$), $\mu$sec | 500 | |
| Protons/sec | $6 \times 10^{15}$ | |
| Target | Uranium | Copper |
| Neutron Source Intensity, n/sec | $2 \times 10^{17}$ | $7 \times 10^{16}$ |
| Neutron Flux (Target Cavity), n/cm²-sec | $\sim 10^{14}$ | $<10^{14}$ |
| Energy Spectra Mean, MeV | 2 | 4 |
| Rotating Neutron Target System (LLL) | | |
| 500-kV Insulated Core Transformer System. | | |
| Beam Energy (Deuteron), keV | 400 | |
| Current, mA | 8 | |
| Target | T | |
| Rotational Speed, rpm | 1100 | |
| Neutron Source Intensity (Initial), n/sec | $2 \times 10^{12}$ | |
| Flux (½ cm from target), n/cm²-sec | $\sim 10^{12}$ | |
| Target Half-life, mAh | ~ 700 | |
| Neutron Energy, MeV | 13–15 | |

One concept which offers immediate promise in producing an intense flux of 14 MeV neutrons is that of a thermal neutron converter. For this purpose materials such as LiOH—$D_2O$ salts or LiD within converter plates have been suggested for installation within high flux, thermal neutron, reactor systems. The approximately 14 MeV neutrons of these concepts are produced by the following reactions:

$$^6\text{Li} + n \text{ thermal} \rightarrow t + {}^4\text{He}$$

and $$t + d \rightarrow {}^n 14 \text{ MeV} + {}^4\text{He}$$

Unfortunately only up to about $10^{-4}$ neutrons of 14 MeV energy per thermal neutrons are produced by these reactions based on the interaction rate as represented by the cross section of the $(d + t)$ reaction.

SUMMARY OF THE INVENTION

Therefore in view of the limitations of prior neutron source systems, it is an object of the present invention to provide an improved neutron source and method for producing approximately 14 MeV neutrons.

It is a further object to provide a method of producing approximately 14 MeV neutrons from a thermal neutron source in which the rate of conversion is more than $10^{-4}$ MeV neutrons per thermal neutron.

It is a further object to provide a materials testing device that can be used to expose a sample material to a high flux of about 14 Mev neutrons produced from thermal neutron flux.

In accordance with the present invention, fissionable material such as $U^{235}$ is contacted with a deuterium - tritium gas mixture in the presence of a thermal neutron flux. As a result the following reactions occur to produce an intense flux of about 14 MeV neutrons:

$$^{235}\text{U} + n_{thermal} \rightarrow 2 \text{ fission fragments} + 2.3\ n_{fast}$$

$$2 \text{ fission fragments} + (d \text{ or } t) \rightarrow (d \text{ or } t)_{\sim 100\ Kev}$$

$$(d \text{ or } t)_{\sim 100\ Kev} + (t \text{ or } d) \rightarrow 3.5 \times 10^{-4}\ (n_{14\ Mev} + {}^4\text{He})$$

A materials testing device employing these reactions includes a plurality of foils containing fissionable material enclosed within a vessel also containing a sample of the material to be tested. The vessel is filled with a mixture of deuterium - tritium gas and exposed to a thermal neutron flux. A coolant system utilizing the circulation of the deuterium - tritium gas mixture is included to remove the heat generated by the reactions.

BRIEF DESCRIPTION OF THE DRAWINGS

The present invention is illustrated in the accompanying drawings wherein.

DETAILED DESCRIPTION OF THE PREFERRED EMBODIMENT

Figure 1:
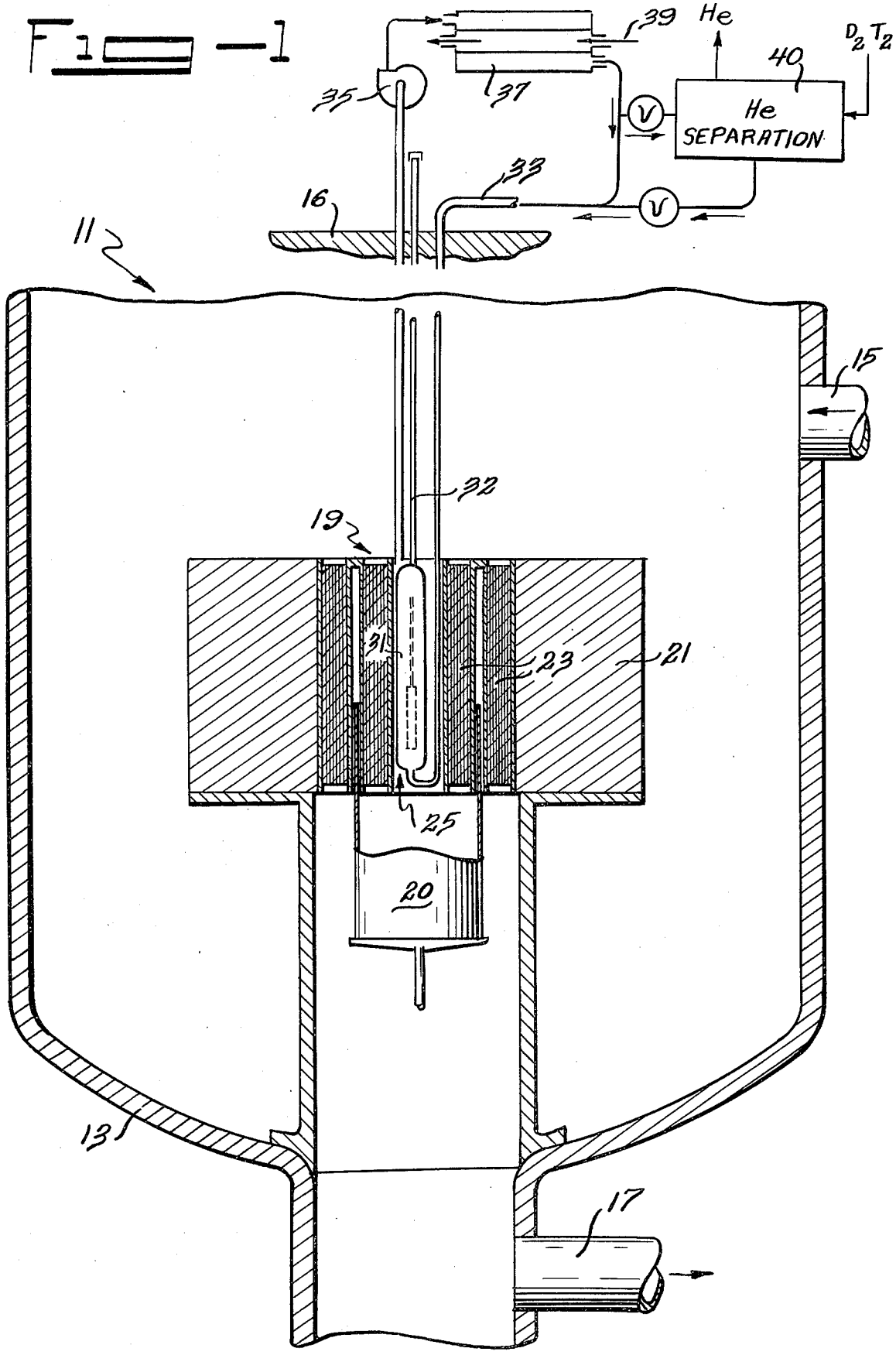
FIG. 1 is a generally schematic view, partially in cross section showing a high flux, thermal neutron reactor including a neutron converter device for materials testing.

Referring to FIG. 1, a high-flux thermal-neutron-nuclear reactor 11 is illustrated. The reactor is generally of the same type as the high flux isotope reactor (HFIR) at Oak Ridge which is more completely described in *Proceeding of the Third International Conference on the Peaceful Uses of Atomic Energy*, Vol. 7, Research and Testing Reactors, pp. 360–368 (United Nations, N.Y. 1965). As illustrated, the reactor includes a reactor vessel 13 with a coolant water inlet 15 and outlet 17. A barrier 16 at the top of the reactor is illustrated to separate components that would ordinarily be outside the reactor although not necessarily outside a shielded facility.

The reactor core 19 includes a cylindrical beryllium reflector 21 surrounding reactor fuel elements 23 that are shaped as vertical curved plates. A control cylinder 20 containing neutron absorbing material is shown partially withdrawn from the bottom of core 19. The open central region, that is the flux trap 25, is filled with water which serves as a neutron moderator and extends the length of the core. For clarity in the drawing, the water is not shown, but it is well known that such is used as a moderator in the flux traps of reactors like the HFIR. It is in the flux trap region that high thermal-neutron flux are obtained.

Within the flux trap 25 is illustrated a thermal neutron converter 31 that is a part of a materials testing device. The converter 31 is provided with an access tube 32 extending outside the reactor vessel 13 for installing and removing samples or other objects that are to be exposed to high flux of 14 MeV neutrons. Also included as a part of the test device is a conduit loop 33 containing a compressor 35 or other means for circulating a mixture of deuterium-tritium gas through the converter 31. The loop 33 is provided with a heat exchanger 37 including means for circulating a coolant 39 in indirect heat exchange relation with the deuterium-tritium gas. For example, a shell and tube or a concentric pipe type of heat exchanger bundle with suitable coolant pumps could be used for this purpose. Also illustrated is a helium separation facility 40 valved in parallel to conduit loop 33. Facility 40 would be employed periodically for removing helium gas produced along with adding makeup deuterium-tritium gas. The helium separation is carried out by a conventional process such as low temperature fractionation or other suitable process.

Figure 2:
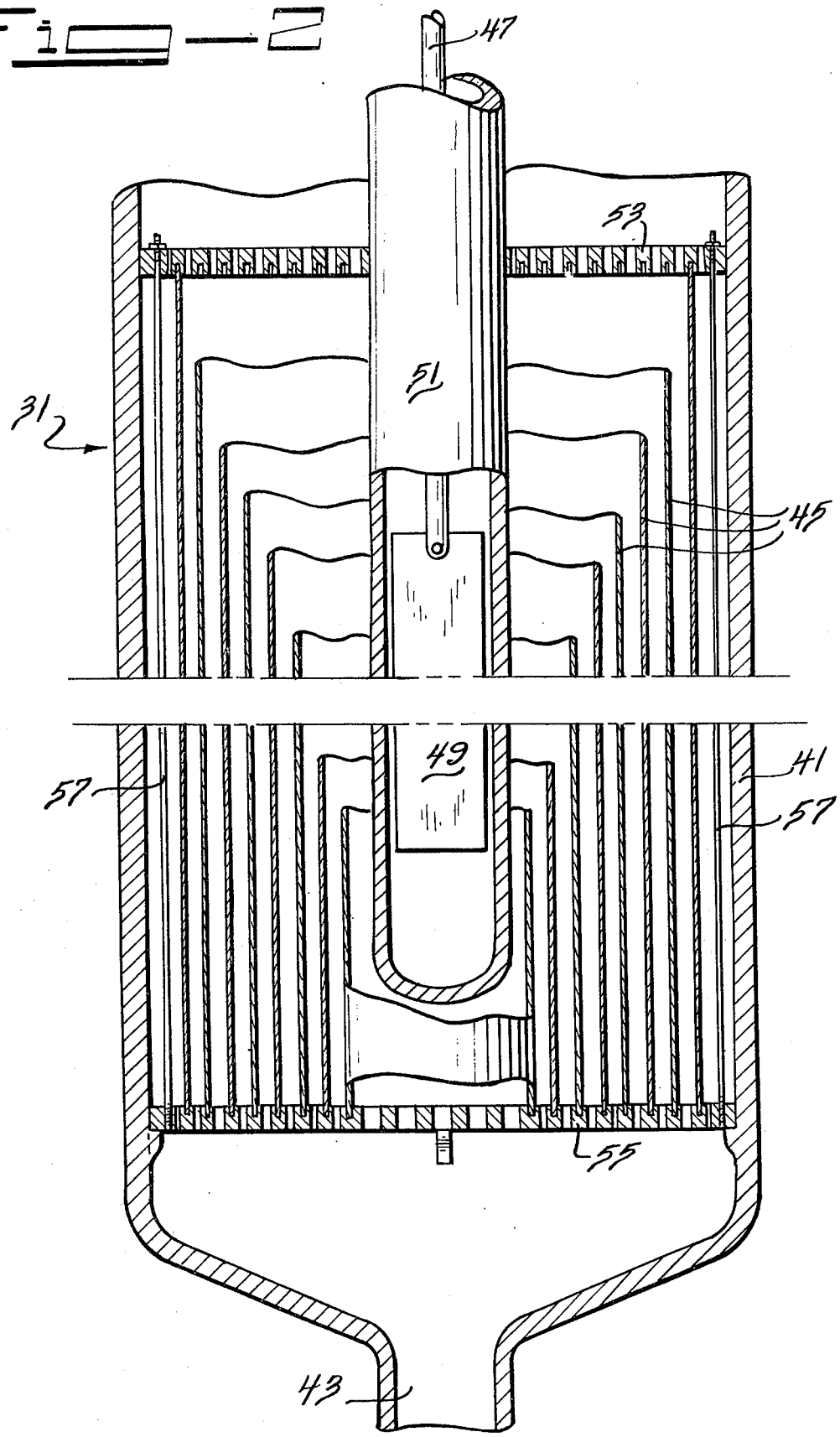
FIG. 2 is an enlarged cross section of a portion of the neutron converter device illustrated in FIG. 1.

Turning now to FIG. 2 where a more detailed illustration of the neutron converter 31 is presented. The converter is shown contained within a cylindrical shaped vessel 41 having an inlet 43 and an outlet (not shown in FIG. 2) for circulation of the deuterium-tritium gas mixture flowing within conduit loop 33 (FIG. 1). A plurality of thin-wall foils 45 containing fissionable materials are shown as concentric cylinders within vessel 41 surrounding a centrally disposed target support member 47. Member 47 is fixedly attached to a target material 49 or sample that is to be exposed to a high flux of approximately 14 MeV neutrons. In test applications where the target material is to be removed or replaced without disturbing the converter 31, the support member 47 will extend to an accessible location outside the reactor through tube 32 (FIG. 1). Although not shown suitable shielding and handling devices would be employed for changing samples.

For tests in which the target is to be bombarded with only neutrons of approximately 14 MeV energy, a shield tube 51 is provided to enclose target 49 and block high-energy deuterons, tritons and fission fragments. Shield tube 51 will, of course, interconnect with access tube 32 (FIG. 1) at the upper end of converter 31.

In most instances target 49 can be maintained at a sufficiently low temperature by the flow of deuterium-tritium gas through the converter device. Where additional cooling is needed, a separate coolant loop (not shown) could be provided within tubes 32 and 51. However, in applications where shield tube 51 is omitted the circulation of deuterium-tritium gas will be in direct contact with target 49 to provide effective cooling.

It will be clear that other schemes for circulating the deuterium-tritium gas can also be provided within the scope of applicants' invention. For example, the return of gas from the heat exchanger 37 to the lower inlet 43 of converter device 31 could be passed through a separate channel within vessel 41, e.g. a centrally located, open-ended tube in place of shield tube 51 could be employed for both sample shielding and gas return along with providing coolant gas in contact with the target.

Foils 45 are illustrated as cylindrical members with surfaces positioned transverse to the direction of thermal neutron flux. The cylindrical shape is a particularly suitable configuration for use in a flux trap with the reactor fuel 23 (FIG. 1) surrounding the neutron converter 31. This configuration establishes a flux of 14 MeV neutrons, from all circumferential directions, at the foil axis where the target material 49 is positioned. However, this is not to exclude other foil configurations such as flat or curved members in stacks or series alignment.

The foils 45 are shown supported between upper 53 and lower 55 grid members, each having sufficient open area for passage of the deuterium-tritium gas flow. Vertical rods 57 connect the two grids 53 and 55 to consolidate the foils 45 into a cartridge. Where extremely thin foils are used, vertical ribs or grid type supports can be employed between the foils provided openings for gas flow are included.

The foils are composed of a metal containing a fissionable material. For example, uranium metal enriched to contain a major portion, that is more than 50% by weight $^{235}U$ could be employed for use in the illustrated embodiment. However, it is preferable that the $^{235}U$ enrichment be as high as possible with the standard enrichment of 93% by weight $^{235}U$ being a practical composition from which the foils can be provided.

The foils are preferably sufficiently thin to facilitate release of fission fragments following thermal neutron induced fission. Foils of less than about 25 microns will function satisfactory but thicknesses of at least 8 microns will ordinarily be used for structure strength.

To gain full benefit of the thermal neutron flux provided by the reactor, it is preferable that a sufficient number of foils be provided in series to be black to thermal neutrons between the thermal neutron source and the target. For 25 micron foils arranged in concentric cylinders at least about 7 to 10 foils should be employed. However, it will be understood that the number of foils required to block a thermal neutron flux will vary with the intensity of that flux and the thickness of the foils.

The foils are spaced sufficiently far apart to provide space for deuterium-tritium gas flow. A sufficient space for gas is needed to allow fission fragments released from the foils to collide with and accelerate deuterons and tritons of the gas. Also, space for an adequate flow of gas to cool the foils and in some applications the target material is to be provided. As an example foil spacings of at least 3 millimeters, and to conserve space, foil spacings in a range of about 3 to 6 millimeters should be sufficient for most neutron converter devices as described herein.

The deuterium-tritium gas pressure is preferably maintained at a high level, particularly between the foils 45 to provide high gas density and thereby increase the probability of collision between fission fragments and deuterons or tritons. Elevated gas pressures also decrease the average path length of a fission fragment to permit closer spacing of the foils 45. Practical gas pressures of about 10 to 100 atmospheres and even higher are contemplated in the neutron converter 31. However at very high pressures the disadvantages resulting from thick containment walls such as neutron flux attenuation, space considerations and other containment problems in the system will outweigh the gains attributable to increased gas density.

In order to evaluate the performance of the neutron converter system, the following basic equation is presented:

$$X = A \int_0^{E_o} \frac{dE_1}{B} \int_0^{Q_{max}} \frac{dQ}{Q^2} \int_0^{Q} \frac{dE_a}{C} \quad (1)$$

where:

$A = N_f n_d n_t K$ $$B = \left(\frac{dE}{dx}\right)_f E_1$$

$$C = \left(\frac{dE}{dx}\right)_a [\sigma_a(E_a)]^{-1}$$

Here X gives the number of 14 MeV neutrons produced by $N_f$ fission fragments of energy $E_o$, mass $M_1$, charge $eZ_1$, striking particles ($d$ or $t$) of mass $M_a$, charge $eZ_a$. The expression is summed over the four cases in which a light or heavy fragment strikes a deuteron or a triton. The other symbols are:

$n_d$, $n_t$ are atomic densities of deuterium and tritium, respectively, in the pressurized gas mixture;

$$K = \pi \left(\frac{e^2}{mc^2}\right)^2 (mc^2)^2 \frac{M_1 Z_1^2 Z_a^2}{M_a} = E_1 Q^2 \frac{d\sigma}{dQ}$$

$$= 6.5135 \times 10^{-26} \text{ (MeV. cm)}^2 Z_1^2 Z_a^2 M_1/M_a.$$

where:

Z is atomic number; $e$ is electron charge;

$mc^2$ is the rest energy of an electron;

Q is the initial energy of the recoiling particle;

$$Q_{max} = \frac{4M_1M_a}{(M_1 + M_a)^2} E_1 \quad ;$$

$E_1$ is the energy (variable) of a fission fragment as it slows down in the gas;

$$\left(\frac{dE}{dx}\right)_f, \left(\frac{dE}{dx}\right)_a$$

are the stopping powers respectively for the fragments and for the first recoil particle (energy loss per interval of path); and $\sigma_a(E_a)$ = the cross section for either the reaction $t(d,n)^4$ He or $d(t,n)^4$He. In terms of laboratory energies $$\sigma(E_d) = \sigma\ (\tfrac{2}{3} E_t).$$

Values for cross sections of the reaction $d(t,n)^4$He and the energy loss rates of both the recoil deuterium, tritium particles and of the fission fragments were taken from the literature. (See applicants' report AN-CR-1134 cited above and incorporated by reference herein.) Through use of computer techniques the process of equation 1 was evaluated between fission fragment energies of 0.005 MeV and $E_o$.

The contributions from the four possible reactions are not equal. Assigning average kinetic energy and mass to each of the two fission fragments:

| | $^n$14 MeV/$^n$thermal |
|---|---|
| $^f$light → $^d$accelerated $^t$stationary | → $0.67 \times 10^{-4}$ |
| $^f$heavy → $^d$accelerated $^t$stationary | → $1.48 \times 10^{-4}$ |
| $^f$light → $^t$accelerated $^d$stationary | → $0.44 \times 10^{-4}$ |
| $^f$heavy → $^t$accelerated $^d$stationary | → $0.98 \times 10^{-4}$ |
| TOTAL | $3.57 \times 10^{-4}$ |

where $^f$light are particles of less than 118 atomic weight and $^f$heavy are particles of more than 118 atomic weight. These models show that the heavy fragment accelerating deuterons produces the greatest number of 14 MeV neutrons. While the mass of the fission fragments cannot be changed appreciably in thermal neutron fission, it might be expected that adjusting the ratio by volume of deuterium as compared to tritium would increase the yield. However, in the practice of the present invention an equal mixture of deuterium and tritium is preferred to provide the maximum yield. This occurs even though the number of accelerated deuterons is increased by enriching the gas with deuterium because that increase is offset by a corresponding decrease in the number of target tritons thus decreasing the total yield. The total yield is decreased by about 4% with a 40–60 or 60–40 mixture as compared to a 50–50 mixture of deuterium and tritium.

A converter system with a 50–50 volume ratio of deuterium and tritium employed within the flux trap of a reactor such as the HFIR where a thermal driving flux of $3 \times 10^{15}$ $n$/cm$^2$-sec is available will provide an approximately 14 MeV neutron flux of about $10^{12}$ n/cm$^2$-sec. Various other reactors such as the ATR (Aerojet Nuclear Test Reactor at Idaho Falls) that have thermal neutron flux of about $10^{15}$ $n$/cm$^2$-sec could also be used with a slightly decreased 14 MeV neutron flux of about $3 \times 10^{11}$ $n$/cm$^2$-sec.

A comparison of the present converter system installed within the ATR with other neutron sources is presented below in Table II. The comparison with LAMPF is uncertain at this time because absolute flux calculations and confirming measurements were not complete.

TABLE II

COMPARISON OF FISSION FRAGMENT DRIVEN SOURCE WITH OTHER NEUTRON SOURCES

| | NEUTRON FLUX (n/cm² sec) | | | |
|---|---|---|---|---|
| | Total Fast | >10 MeV | >14 MeV | >20 MeV |
| FISSION FRAGMENT DRIVEN | | | | |
| d+t neutron source | | | | |
| a) from reactor | | | | |
| fast spectra (ATR) | $1/3 \times 10^{15}$ | $1/3 \times 10^{12}$ | $5/3 \times 10^{9}$ | $10^7$ |
| b) from d+t | $3 \times 10^{11}$ | $3 \times 10^{11}$ | $3 \times 10^{11}$ | 0 |
| TOTAL | $1/3 \times 10^{15}$ | $2/3 \times 10^{12}$ | $3 \times 10^{11}$ | $10^7$ |
| FISSION SPECTRA (example) | $10^{15}$ | $10^{12}$ | $5 \times 10^{9}$ | $3 \times 10^7$ |
| LAMPF | $10^{13} - 10^{14}$ | ~10% of total | few % of total | still relatively high |
| EBR-II | $3 \times 10^{15}$ | $7.7 \times 10^{11}$ | $3.5 \times 10^{9}$ | $2.2 \times 10^7$ |

TABLE II-continued

COMPARISON OF FISSION FRAGMENT DRIVEN SOURCE WITH OTHER NEUTRON SOURCES

| | NEUTRON FLUX (n/cm² sec) | | | |
|---|---|---|---|---|
| | Total Fast | >10 MeV | >14 MeV | >20 MeV |
| LLL (rotating target) | $\sim 10^{12}$ | 0 | $\sim 10^{12}$ | 0 |

As can be seen from table II, the neutrons at about 14 MeV produced by fission are an insignificant contribution in comparison with that obtained from the fission fragment driven deuterons and tritons. More importantly it is seen that thermal neutron converter driven by fission fragments produces 14 MeV neutron flux several orders of magnitude above most other sources. The LLL high intensity source is one of the few practical sources for materials testing that is capable of producing 14 MeV neutron flux at a competing level with the fission fragment driven device of the present invention.

It can be seen that the present invention provides a method of efficiently converting a thermal neutron flux to a high-level 14 MeV neutron flux for use as a CTR materials test device. By selecting a reactor that can produce $3 \times 10^{15}$ thermal neutrons/cm²-sec, approximately $10^{12}$ $n$/cm²-sec, 14 MeV neutron flux can be generated. In a year, fluences in excess of $10^{19}$ $n$/cm² can be provided. A device of this type is relatively uncomplicated and can be assembled within existing high flux reactors to enable CTR materials testing to be carried out without a great deal of development work. This method and device are also appreciable improvements over previous techniques which rely on reactions involving lithium to generate high energy neutrons.

The embodiments of the invention in which an exclusive property or privilege is claimed are defined as follows:

1. A method of producing approximately 14 MeV neutrons from fissionable material including $U^{235}$ and a gas mixture including deuterium and tritium gas in about equal proportions by volume comprising: passing said gas mixture over and in contact with said fissionable material; exposing said fissionable material to a thermal neutron flux in order to fission a portion thereof resulting in energetic fission fragments which, in turn, transfer energy to said deuterium and tritium, producing approximately 14 MeV neutrons by the reactions $t(d,n)^4$He and $d(t,n)^4$He.

2. The method of claim 1 wherein said approximately 14 MeV neutrons are received within a sample material for subsequent analysis.

3. The method of claim 1 wherein said gas mixture is circulated within a closed loop in contact with said fissionable material at 10 to 100 atmospheres pressure and is cooled to remove heat generated within said fissionable material.

4. The method of claim 1 wherein said thermal neutron flux is in excess of $10^{15}$ neutrons/cm²-sec and said 14 MeV neutron flux produced therefrom is in excess of $3.5 \times 10^{11}$ neutrons/cm².

5. A materials testing device for exposing a sample to neutrons of about 14 MeV in order to determine the suitability of said samples in controlled thermonuclear fission applications, said device comprising a vessel filled with a mixture of deuterium-tritium gas and adapted to be exposed to and penetrated by a flux of thermal neutrons; a plurality of foils including fissionable material enclosed within said vessel; means for supporting said sample within said vessel; and means for cooling said foils to remove heat released by the fission of said fissionable material.

6. The device of claim 5 wherein said foils are supported in spaced-apart layers with said gas mixture between said layers, each of said foils being of not more than 25 microns in thickness and spaced at least 3 millimeters apart.

7. The device of claim 5 wherein said plurality of foils are concentric cylinders of uranium including a major portion of $U^{235}$, and wherein said means for supporting said sample is axially positioned in respect to said cylinders.

8. The device of claim 5 wherein said housing is filled with an approximately 50 volume percent deuterium and 50 volume percent tritium at a total pressure of 10 to 100 atmospheres.

9. The device of claim 5 wherein said vessel is positioned within the core of a nuclear reactor at a location adapted to sustain a flux of thermal neutrons in excess of $10^{15}$ neutrons/cm²-sec.

10. The device of claim 5 wherein said means for cooling said foils comprises a closed conduit loop connected from one to the opposite end portion of said vessel, said loop including means for circulating said deuterium-tritium gas mixture through said vessel, and a heat exchange apparatus adapted to pass a flow of coolant, said heat exchange apparatus connected within said loop to permit said gas mixture to flow therethrough in indirect heat exchange relation with said coolant flow.

* * * * *